US011833537B2

(12) United States Patent
Peleg et al.

(10) Patent No.: US 11,833,537 B2
(45) Date of Patent: Dec. 5, 2023

(54) ROTATING SPRINKLER

(71) Applicant: NETAFIM, LTD., Tel Aviv (IL)

(72) Inventors: Gad Peleg, Kibbutz Hulda (IL); Nitzan Bustan, Kibbutz Karmia (IL)

(73) Assignee: NETAFIM, LTD., Tel Aviv (IL)

( * ) Notice: Subject to any disclaimer, the term of this patent is extended or adjusted under 35 U.S.C. 154(b) by 429 days.

(21) Appl. No.: 17/243,010

(22) Filed: Apr. 28, 2021

(65) Prior Publication Data

US 2021/0316325 A1 Oct. 14, 2021

Related U.S. Application Data

(63) Continuation-in-part of application No. PCT/IB2019/059066, filed on Oct. 23, 2019.

(60) Provisional application No. 62/752,060, filed on Oct. 29, 2018.

(51) Int. Cl.

| | |
|---|---|
| ***B05B 15/74*** | (2018.01) |
| ***B05B 15/16*** | (2018.01) |
| ***B05B 3/02*** | (2006.01) |
| ***B05B 3/04*** | (2006.01) |

(52) U.S. Cl.

CPC ..... *B05B 15/74* (2018.02); *B05B 3/021* (2013.01); *B05B 3/0481* (2013.01); *B05B 15/16* (2018.02)

(58) Field of Classification Search

CPC ..... B05B 15/74; B05B 15/16; B05B 3/021; B05B 3/0481; B05B 3/06; B05B 1/3006; B05B 3/066; B05B 3/063

See application file for complete search history.

(56) References Cited

U.S. PATENT DOCUMENTS

| | | | |
|---|---|---|---|
| 1,259,902 | A | 3/1918 | Parker |
| 1,863,919 | A | 6/1932 | Brooks |
| 2,151,214 | A | 3/1939 | Kramer |
| 2,514,346 | A | 7/1950 | Snoddy |
| 7,216,817 | B2 | 5/2007 | Turk et al. |

FOREIGN PATENT DOCUMENTS

| | | |
|---|---|---|
| WO | WO 2008/068583 | 6/2008 |

OTHER PUBLICATIONS

International Search Report dated Jun. 29, 2020, in counterpart International (PCT) Application No. PCT/IB2019/059066.

Written Opinion dated Jun. 29, 2020, in counterpart International (PCT) Application No. PCT/IB2019/059066.

*Primary Examiner* — Steven M Cernoch

(74) *Attorney, Agent, or Firm* — Womble Bond Dickinson (US) LLP

(57) ABSTRACT

A rotating sprinkler includes a housing and a movable core. The core can assume retracted and extended states relative to the housing and incudes a cover, an impact member and a stream deflector. In the extended state, both the cover and the impact member can pivot between pivoted and non-pivoted states about a hinge defining an axis H generally orthogonal to axis X and the stream deflector is fixed against rotation about the hinge.

17 Claims, 9 Drawing Sheets

ROTATING SPRINKLER

RELATED APPLICATIONS

This is a Bypass Continuation-in-Part of International Patent Application No. PCT/IB2019/059066, filed 23 Oct. 2019 and published as WO 2020/089738A2 on 7 May 2020. Priority is claimed to U.S. Provisional Patent Application No. 62/752,060 filed 29 Oct. 2018. The contents of the aforementioned applications are incorporated by reference in their entirety.

TECHNICAL FIELD

Embodiments of the invention relate to rotating sprinklers specifically for use in irrigation applications.

BACKGROUND

Irrigation sprinklers are normally required to have a relative uniform distribution of water around an area covered by the sprinkler. Various arrangements exist for addressing this need.

U.S. Pat. No. 7,216,817 for example describes an impact sprinkler drive provided by an impact arm or spoon that rotates out of and counter-rotates into a water stream to impact and forward re-align a water emission portion from which the water stream emits. The impact arm is designed to, upon sufficient rotation, interfere with the water stream to reduce back-impact and reverse re-alignment of the water stream. The impact arm may be an impact spoon formed on an impact disc.

Other arrangements may be proposed for obtaining such uniform distribution of sprinkled water, however, with a simpler construction.

SUMMARY

The following embodiments and aspects thereof are described and illustrated in conjunction with systems, tools and methods which are meant to be exemplary and illustrative, not limiting in scope.

In an aspect of the present invention there is provided a rotating sprinkler comprising a housing and a movable core having retracted and extended states relative to the housing along a vertical sprinkler axis X of the sprinkler, the core comprising a cover (12), an impact member (14) and a stream deflector (16); wherein in the extended state both the cover and the impact member can pivot between pivoted and non-pivoted states about a hinge defining a hinge axis H generally orthogonal to sprinkler axis X and the stream deflector is fixed against rotation about the hinge.

In an aspect of the present invention there is also provided a rotating sprinkler comprising a housing and a movable core having retracted and extended states relative to the housing along a vertical sprinkler axis X of the sprinkler, the core comprising a cover, an impact member, a gear train and a stream deflector; wherein in the extended state liquid flowing through the sprinkler is arranged by the deflector to be split into first and second liquid streams, wherein the first liquid stream is emitted substantially unobstructed to the ambient environment and the second liquid stream at least partially impacts against the impact member to power movement in the gear train that in turn urges rotation of at least a portion of the sprinkler about sprinkler axis X.

In addition to the exemplary aspects and embodiments described above, further aspects and embodiments will become apparent by reference to the figures and by study of the following detailed descriptions.

BRIEF DESCRIPTION OF THE FIGURES

Exemplary embodiments are illustrated in referenced figures. It is intended that the embodiments and figures disclosed herein are to be considered illustrative, rather than restrictive. The invention, however, both as to organization and method of operation, together with objects, features, and advantages thereof, may best be understood by reference to the following detailed description when read with the accompanying figures, in which.

Figure 1A:
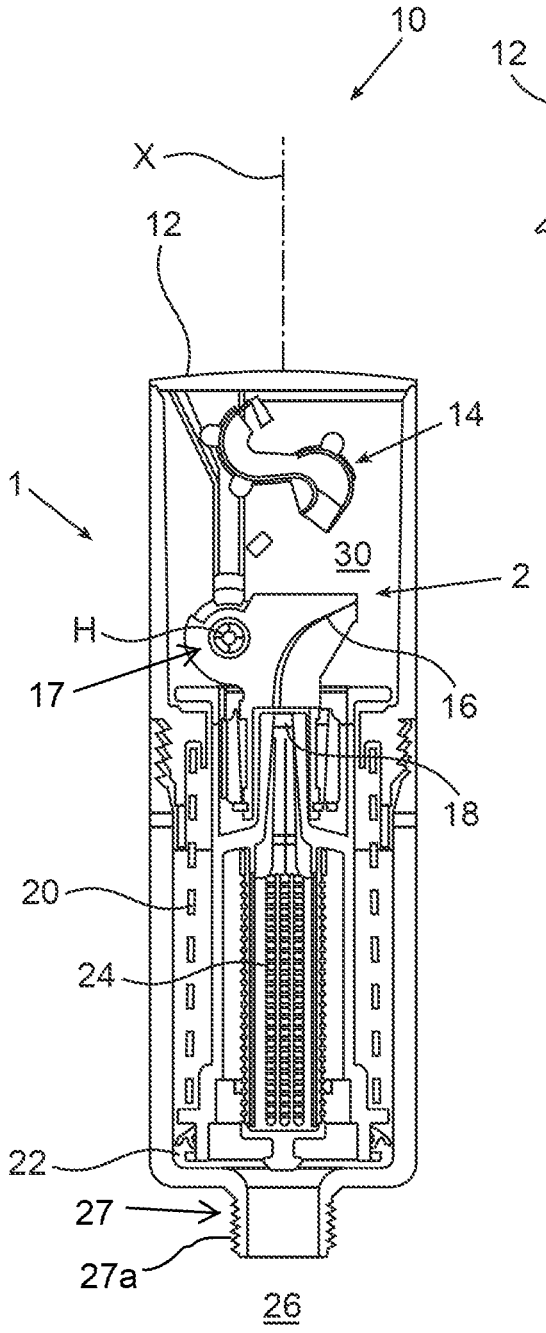
FIGS. 1A and 1B show cutaway side views of a first embodiment of a rotating sprinkler in the retracted and extended states, respectively.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated within the figures to indicate like elements.

DETAILED DESCRIPTION

Figure 1B:
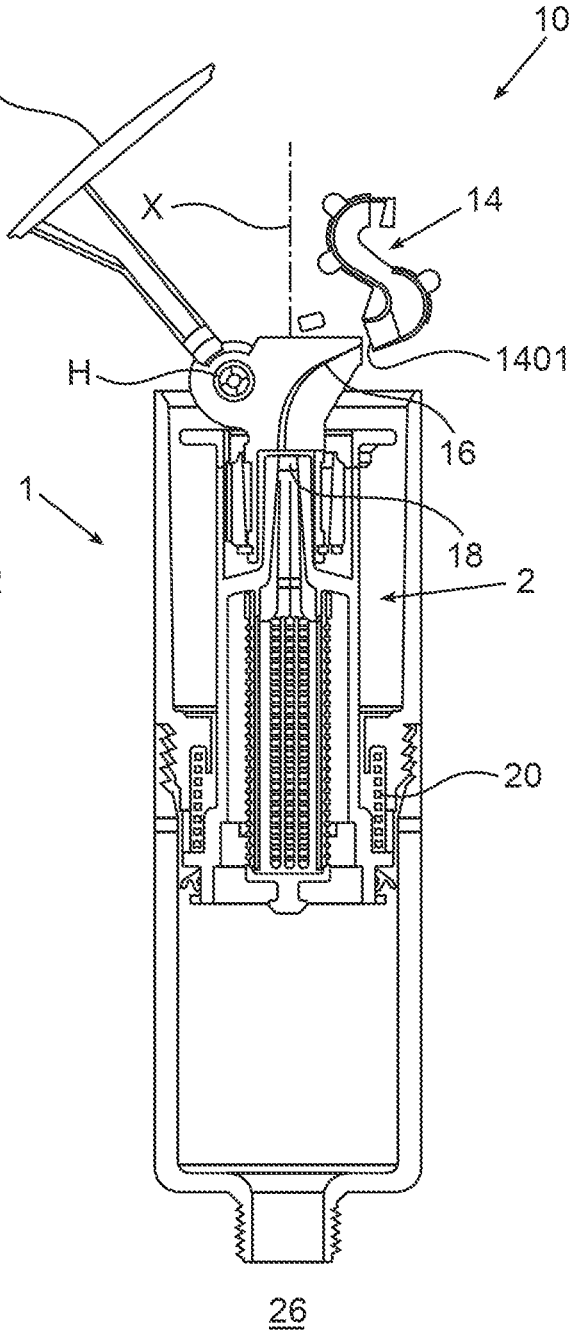

Attention is first drawn to FIGS. 1A and 1B illustrating an embodiment of a sprinkler 10 here of a so-called vertical-type. In FIG. 1A sprinkler 10 is seen in a retracted state and in FIG. 1B in an extended state, where retraction and extension occurs along a sprinkler axis X of the sprinkler. Sprinkler 10 has a stationary outer peripheral housing 1 and a movable core 2 that moves relative to the housing 1. The housing 1 has a generally cylindrical shape and terminates at a lower side thereof in a connector 27. The connector 27 may have an external thread (as shown in FIGS. 1A and 1B) or may have a bayonet or other configuration to attach to an irrigation pipe or other source of irrigation liquid. The movable core 2 includes a foldable cover 12, an impact member 14 having here a generally S-shape in a side view, a stream deflector 16, a nozzle 18, a biasing means 20 here in form of a compression spring, a seal 22 and a filter 24. An inlet 26 formed here at a lower side of housing 1 is arranged to permit entry of liquid into the sprinkler via the connector 27.

When idle, e.g. when exposed to substantially "zero" pressure or a pressure below an 'activation threshold' at inlet 26, the core of sprinkler 10 is arranged to be maintained in a retracted state in relation to housing 1 due to biasing means 20. Upon exposure to substantial pressurized liquid entering inlet 26 from upstream, the sprinkler's movable core 2 is arranged to be urged upwards along sprinkler axis X, against biasing means 20 towards the sprinkler's extended state. Said 'activation threshold' may be determined, inter alia, according to the biasing force applied by biasing means 20.

With attention additionally drawn to FIGS. 2A to 2D it is seen that both impact member 14 and cover 12 can be arranged to rotate about a hinge 17 having a hinge axis H extending through a body 160 on which the stream deflector 16 is formed. Hinge 17 has an axial extension generally orthogonal to sprinkler axis X. An arm 140 linking impact member 14 to hinge 17 here includes a secondary stop 141, body 160 here includes a first primary stop 161 and cover 12 here includes a bulge 121.

Cover 12 can be urged to rotate about hinge 17 (in a rotational direction R2 indicated in FIGS. 2A and 2B) possibly via a biasing means (not shown) until its bulge 121 meets and abuts against primary stop 161. This is referred to as the "pivoted position" of the cover 12. The urging of the cover 12 to rotate about hinge 17 can occur in the extended state of the sprinkler.

Figure 2A:
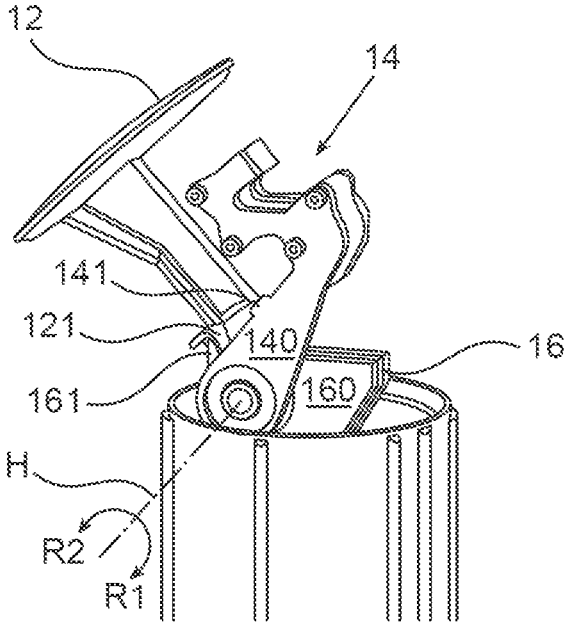
FIGS. 2A and 2B are two different perspective views of the sprinkler seen in FIGS. 1A and 1B with the impact arm occupying two different positions.
Figure 2B:
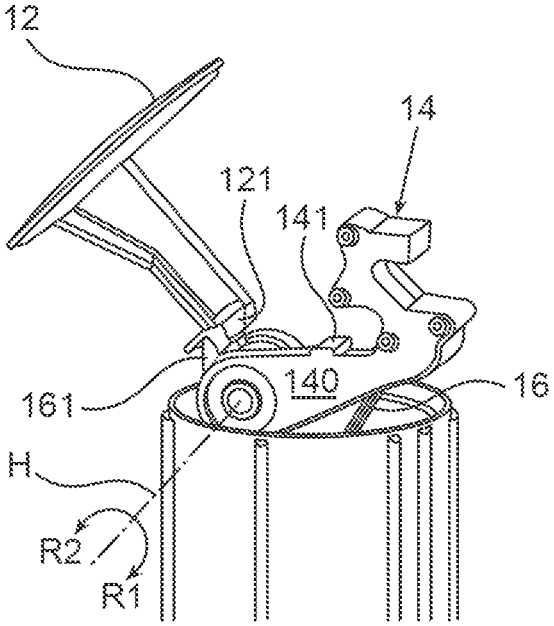
Figure 2C:
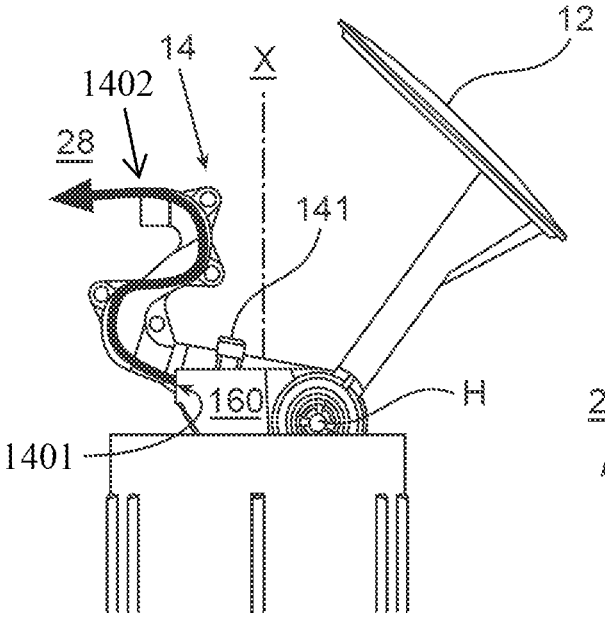
FIGS. 2C and 2D are two views of the sprinkler of FIGS. 1A and 1B, seen emitting a liquid jet.

Impact member 14 can rotate (possibly due, inter alia, to gravitational force) in a rotational direction R1 towards a pivoted position (seen e.g. in FIG. 2B) where secondary stop 141 bears against body 160 to position an entry 1401 of impact member 140 opposite deflector 16 in a position suitable to receive a liquid jet emitted downstream via deflector 16 (see, e.g., FIG. 2C).

Impact member 14 can additionally be urged to rotate about hinge 17 in the rotational direction R2 (a counter direction to R1) towards a non-pivoted position where it can meet and bear against bulge 121 possibly when bulge 121 bears against stop 161 (see FIG. 2A). Thus, as seen from FIGS. 2A and 2B, in the extended state, the cover 12 and the impact member 14 can pivot independently from one another, about the hinge 17.

Figure 2D:
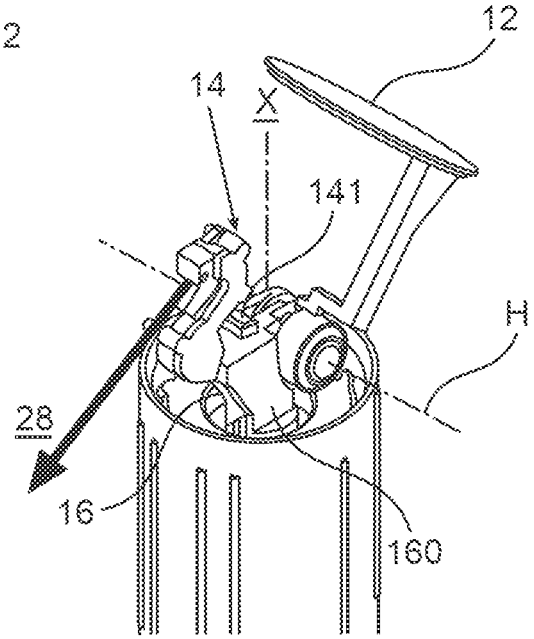

Arrow 28 indicated in FIGS. 2C and 2D illustrates the S-shaped path that a liquid jet emitted out of deflector 16 passes through impact member 14. The liquid jet emitted out of impact member 14 via exit 1402 to the ambient environment may be arranged by the formation of impact member 14 to form vector forces urging both rotational forces about a sprinkler axis X of the sprinkler and about hinge 17.

Figure 3A:
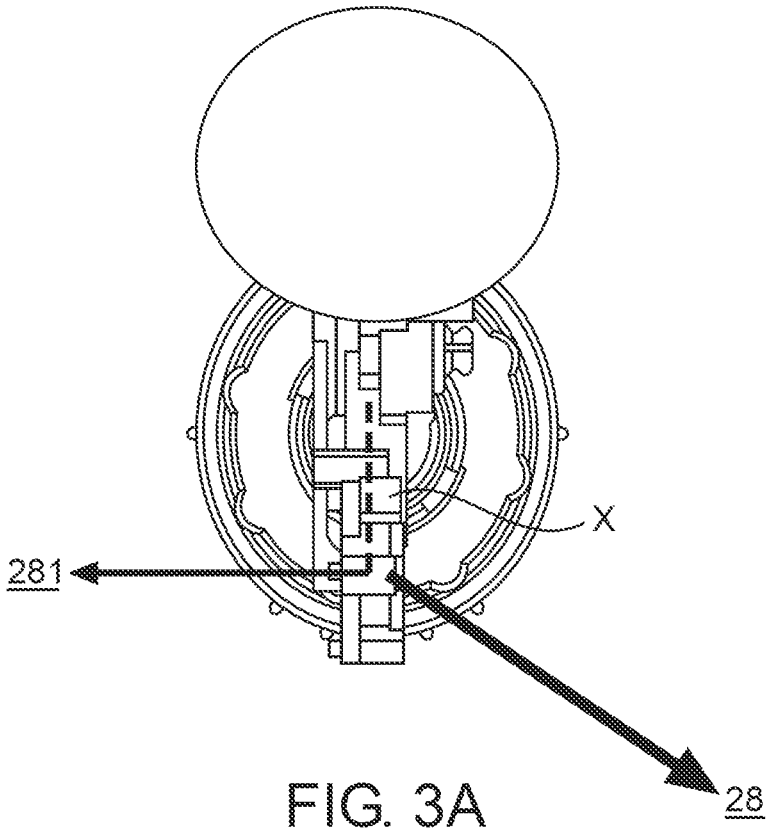
FIGS. 3A and 3B are two views of the sprinkler seen in FIG. 1B, showing the vector forces created by the liquid jet.
Figure 3B:
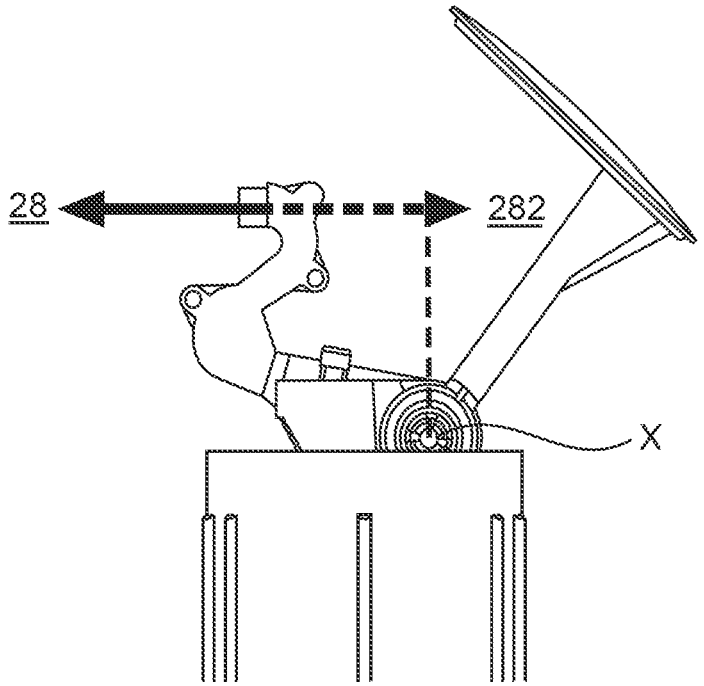

Attention is drawn to FIGS. 3A and 3B illustrating the discussed vector forces formed by liquid jet 28 as it is emitted out of impact member 14 to the ambient environment. A first vector force 281 (see FIG. 3A) urges moment force about sprinkler axis X and thus rotation of the sprinkler's core about sprinkler axis X. A second vector force 282 (see FIG. 3B) urges moment force about hinge 17 and thus rotation of impact member 14 about hinge 17 in the rotational direction R2.

During start of an irrigation process, pressurized liquid entering sprinkler 10 in its retracted state is arranged to flow via filter 24, nozzle 18 and deflector 16 and initially fill a void 30 located below cover 12 (see void 30 indicated in FIG. 1A). The pressurized liquid bearing against the members of sprinkler's core initially urge the sprinkler to lift towards its extended state seen in FIG. 1B.

The liquid jet 28 then passing through impact member 14 and forming the vector forces 281, 282 when emitted to the ambient environment, is arranged to form incremental rotational steps about sprinkler axis X. Such incremental steps may be formed due to the combined movements about sprinkler axis X and hinge axis H formed by the emitted liquid jet 28. The rotation about sprinkler axis X formed by vector force 281 goes on until the entry 1401 of impact member 14 is urged by vector force 282 out of liquid communication with liquid flowing out of deflector 16.

Figure 4A:
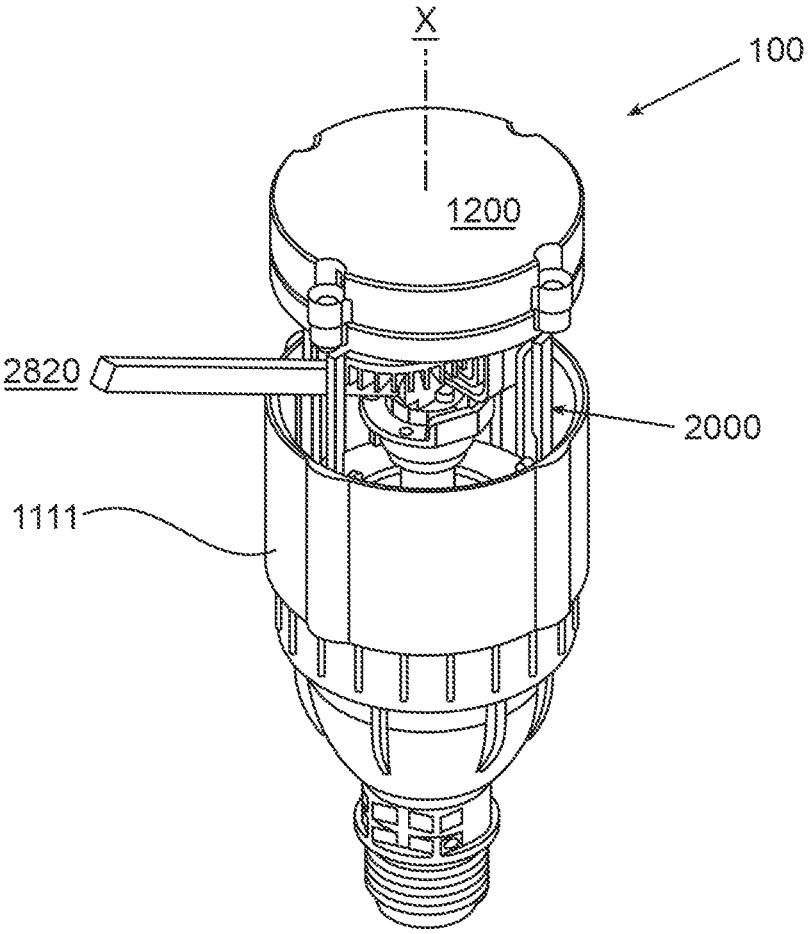
FIGS. 4A and 4B are top and bottom perspective views, respectively, of a second embodiment of a rotating sprinkler, in the extended state.
Figure 4B:
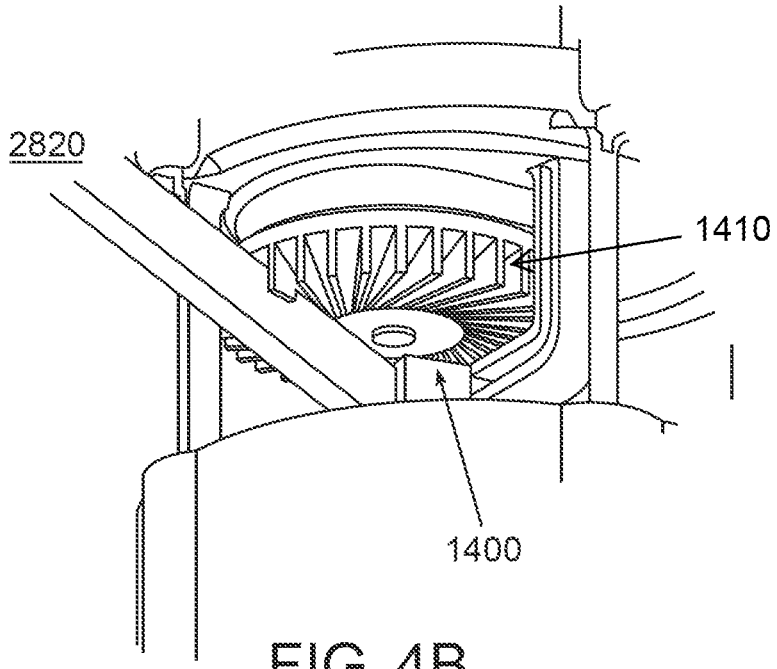
Figure 5:
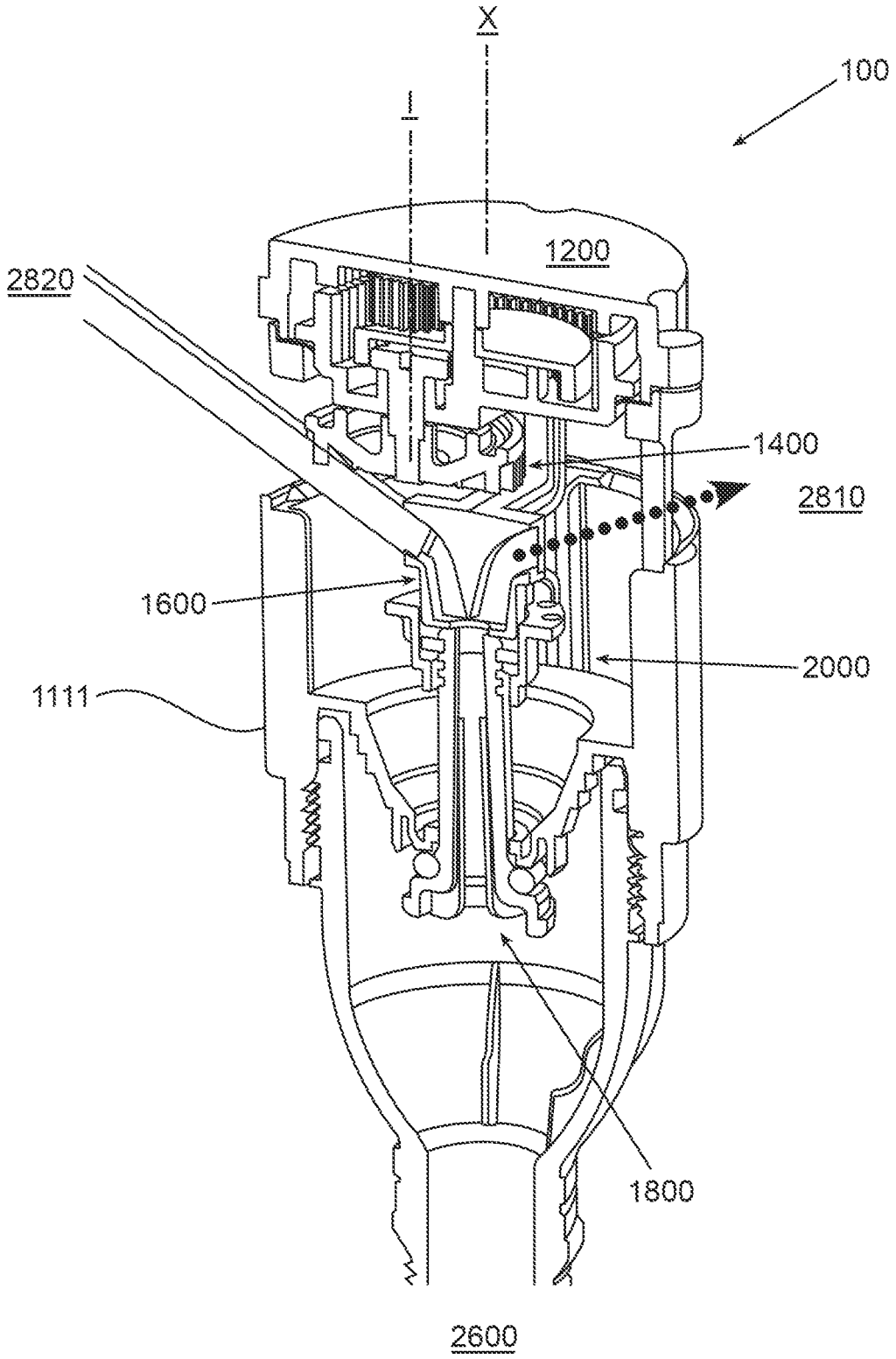
FIG. 5 is a cutaway view of the sprinkler seen in FIGS. 4A and 4B, showing liquid being split into two streams.

Attention is drawn to FIGS. 4A, 4B and 5 illustrating another embodiment of a sprinkler 100 of the present invention. In these figures sprinkler 100 is seen in an extended state along a sprinkler axis X of the sprinkler. Sprinkler 100 has a stationary outer peripheral housing 1111 and a movable core 2000 that includes a cover 1200, an impact member 1400 here in form of a rotor, a stream deflector 1600 and a nozzle 1800. An inlet 2600 formed here at a lower side of housing 1111 is arranged to permit entry of liquid into the sprinkler.

When idle, the core of sprinkler 100 is arranged to be maintained in a retracted state in relation to housing 1111 (not shown). Upon exposure to pressurized liquid entering inlet 2600 from upstream, the sprinkler's movable core 2000 is arranged to be urged upwards along sprinkler axis X towards the sprinkler's extended state.

In the extended state, liquid flowing through the sprinkler is arranged by deflector 1600 to be split into two streams. A first stream 2810 illustrated by the 'dotted arrow' in FIG. 5 is arranged to reach relative large distances since it has a general "free" path out of the sprinkler 100 to the ambient environment. A second stream 2820 is arranged to impact the rotor 1410 of impact member 1400 and urge it to rotate about a rotor axis I which is generally parallel to sprinkler axis X.

Figure 6A:
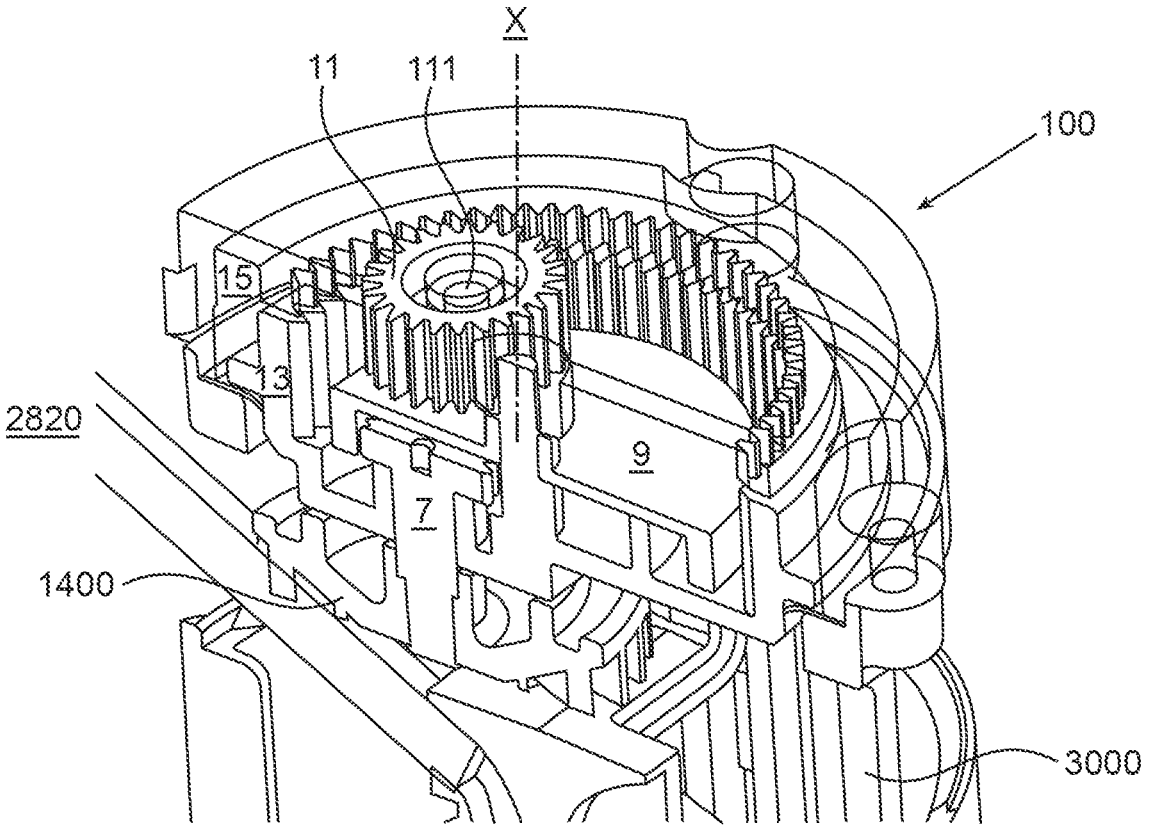
FIGS. 6A and 6B are two perspective views of the sprinkler seen in FIGS. 4A and 4B, showing the gear train.
Figure 6B:
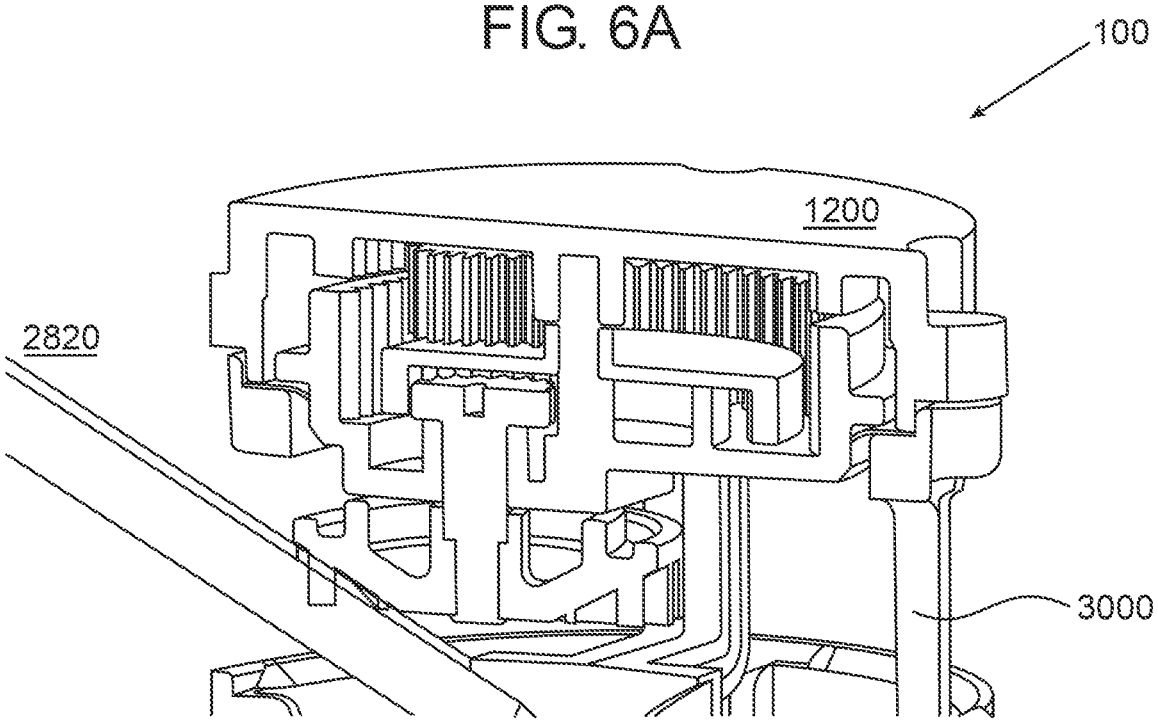

Attention is drawn to FIGS. 6A and 6B for a useful view of a gear train or transmission provided in sprinkler 100. An upper, first cogwheel 7 coupled to rotate with impact member 1400 is arranged to mesh with a second cogwheel 9 ("intermediate cogwheel" 9) and by this meshing engagement urge a first gear ratio reduction. In addition, the interaction of first cogwheel 7 with interior teeth formed within second cogwheel 9 permit placement of impact member 1400 at a location within the sprinkler that is offset from sprinkler axis X.

A third cogwheel 11 in the sprinkler's gear train is fixed for rotation about a pin 111 that acts as an axis of rotation. Pin 111 is fixed to an upper side of second cogwheel 9. Third cogwheel 11 meshes simultaneously with two additional cogwheels 13, 15 (fourth and fifth cogwheels, respectively) both arranged to rotate about sprinkler axis X. Fourth cogwheel 13 is fixed for rotation together with stream deflector 1600 and thus rotation of fourth cogwheel 13 about sprinkler axis X is arranged to also rotate deflector 1600 about sprinkler axis X in the same rotational direction.

Fifth cogwheel 15 in this example is an integral part of cover 1200 and thus may be considered an "internal gear" since it is formed on the internal circumferential surface of the cover 1200. In the example seen in FIGS. 4-6, the cover 1200 is rotationally fixed in relation to housing 1111, and so fifth cogwheel 15 is consequently also rotationally fixed in place. In an embodiment of the invention, fourth and fifth cogwheels 13, 15 do not have a similar number of teeth. For example, in at least certain cases, the number of teeth at fourth cogwheel 13 may be arranged to differ by 'one' from the number of teeth at fifth cogwheel 15. For example, while fourth cogwheel 13 may be designed to have 70 teeth fifth cogwheel 15 may be designed to have only 69 teeth, and hence in such example—for each full rotation of second cogwheel 9 about sprinkler axis X, fourth cogwheel 13 progresses in an angular direction about sprinkler axis X by one tooth in relation to fifth cogwheel 15 (which remains fixed in place).

Rotation of fourth cogwheel 13 accordingly urges displacement of impact member 1400 about sprinkler axis X. Legs 3000 fixed to cover 1200 are arranged to rotationally fix the cover in relation to housing 1111. By way of an example, in the following—rotational directions of elements within sprinkler 100 will be demonstrated. When viewed from above, in an arrangement where first and second cogwheels 7 and 9 and impact member 1400 are arranged to rotate in a first rotational direction (e.g. counter-clockwise motion)—third and fourth cogwheels 11 and 13 will be urged to rotate in a second opposing rotational direction (e.g. clockwise motion)—where the rotational motion of the streams 2810, 2820 about the sprinkler's axis X will be in the second rotational direction.

Figure 7:
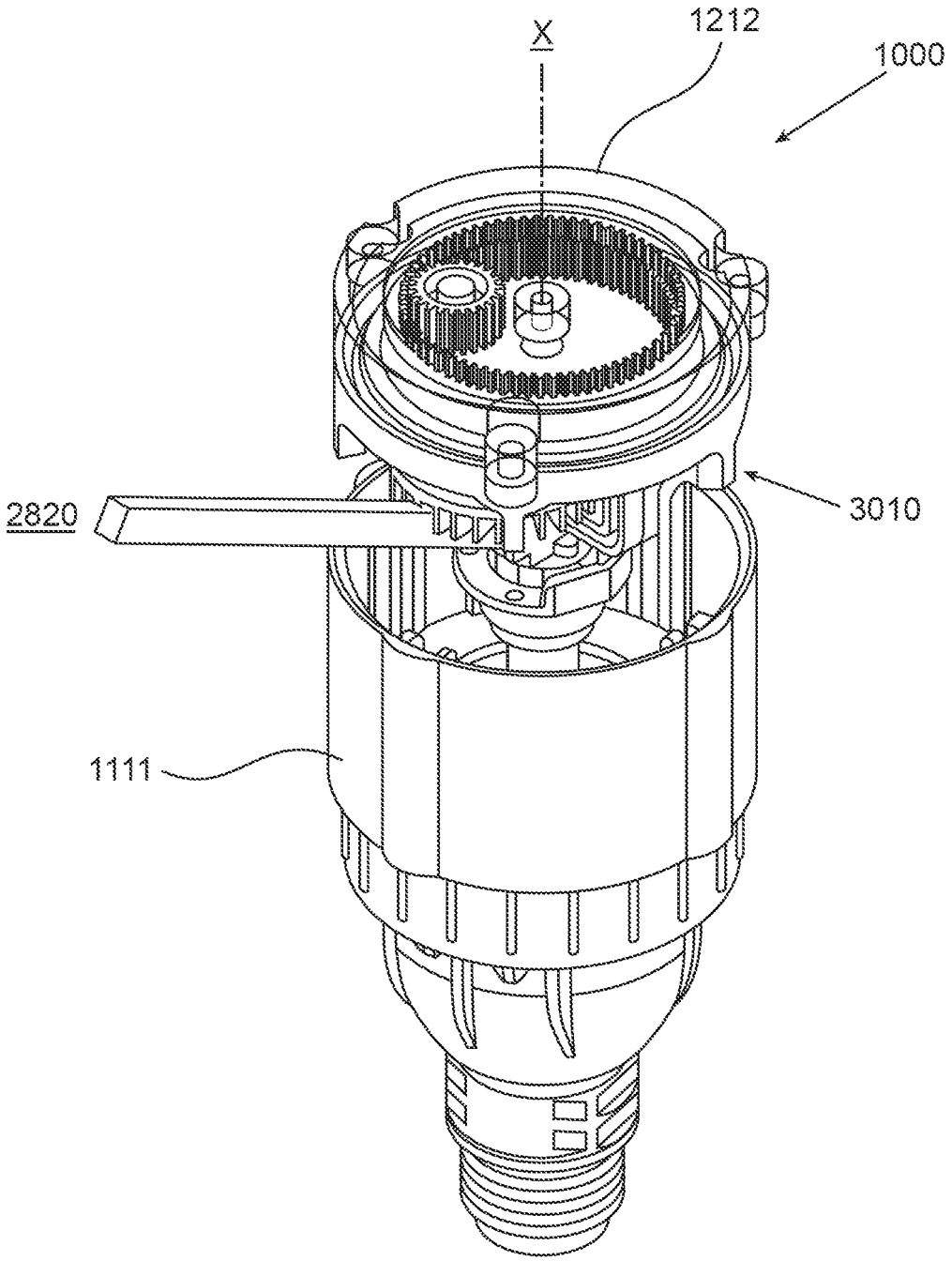
FIG. 7 is a perspective view of a third embodiment of a rotating sprinkler, in the extended state.

Attention is drawn to FIG. 7 illustrating an embodiment of a sprinkler 1000 that mainly differs from sprinkler 100 in being absent of means (such as legs 3000 in the former embodiment) for fixing/halting the rotation of the sprinkler's cover. Instead, sprinkler 1000 may include impinging members 3010 ("impinging pins") fixed to the sprinkler cover 1212 that are arranged to have a profile encouraging rotation of the cover about the sprinkler's axis X each time that an impinging members 3010 is hit by the first "free" liquid stream 2810 ("liquid jet") of the sprinkler. Absence of fixing of the cover against rotation in sprinkler 1000—permits the cover to rotate about the sprinkler's axis X, relative to the housing 1111.

Figure 8A:
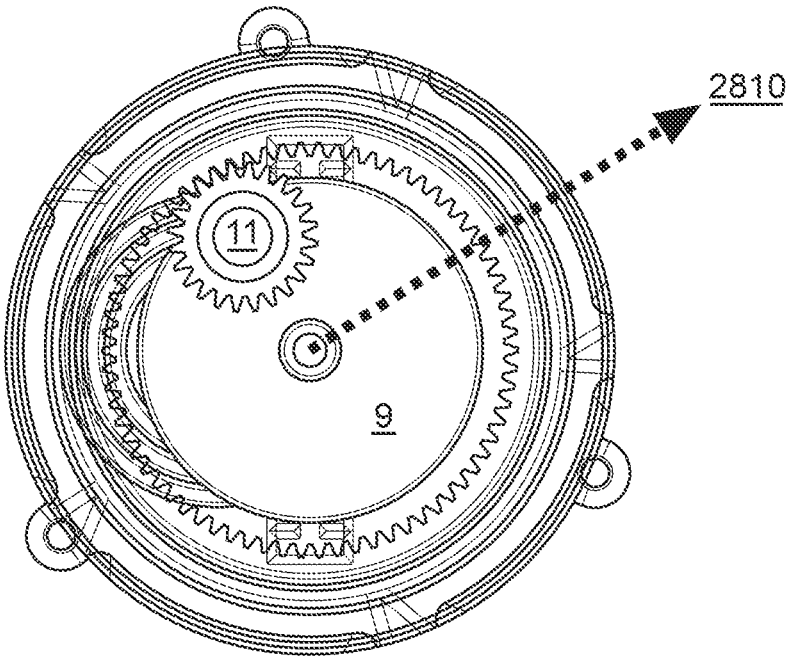
FIGS. 8A and 8B are top cutaway views of the sprinkler seen in FIG. 7, showing an undeflected and a deflected liquid jet, respectively.
Figure 8B:
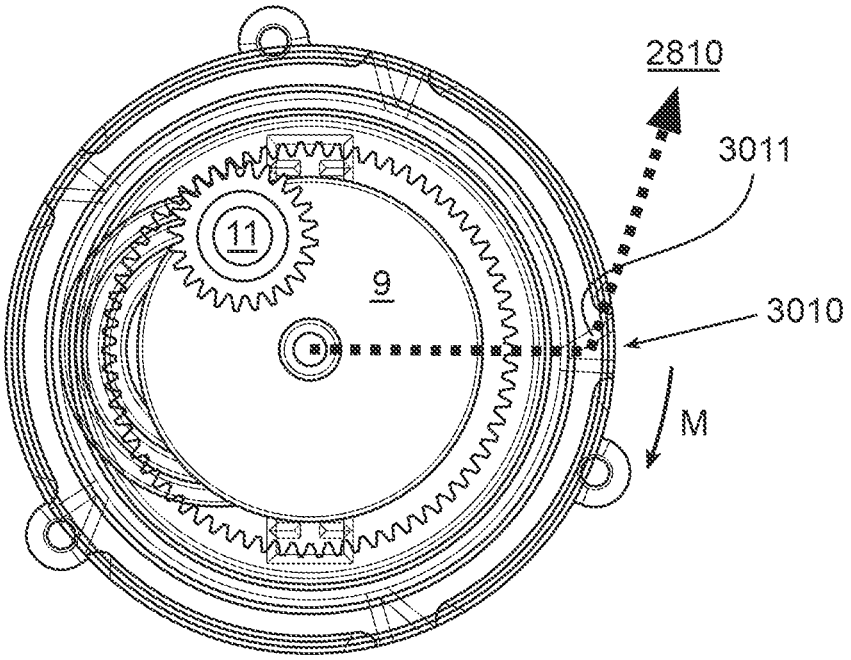

In FIGS. 8A and 8B such a scenario is illustrated, where in FIG. 8A the emitted liquid jet 2810 is seen passing un-obstructed ("free") out of the sprinkler, while in FIG. 8B same liquid jet is seen striking against one of the impinging members 3010 of the cover. The liquid jet 2810 meeting impinging member 3010 is temporarily deflected and forms a moment force M that urges the cover to rotate about the sprinkler's axis X.

Figure 9B:
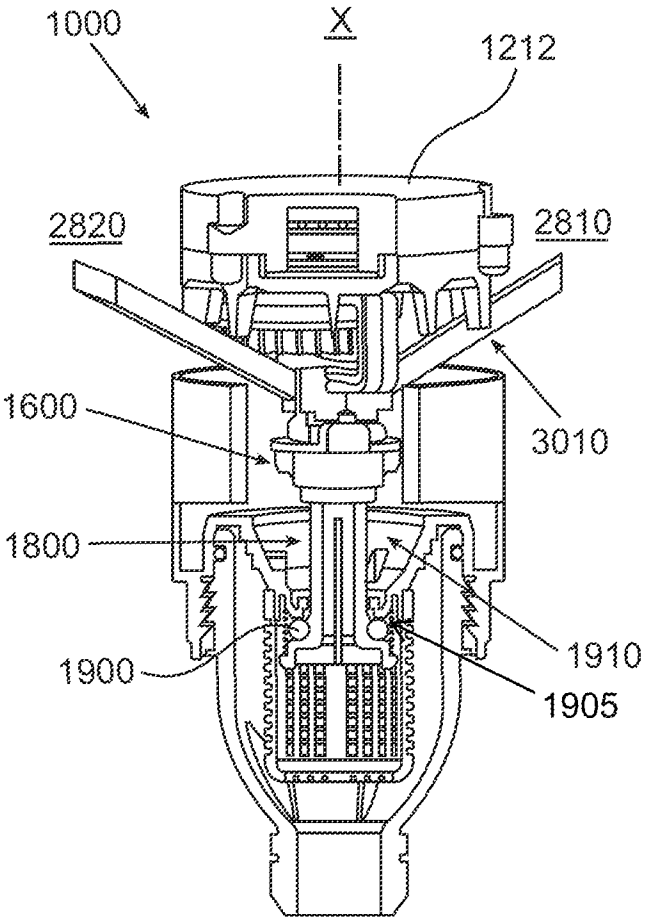
FIGS. 9A and 9B are a perspective side view and a partial cross-sectional view, respectively, of the sprinkler seen in FIG. 7.
Figure 9A:
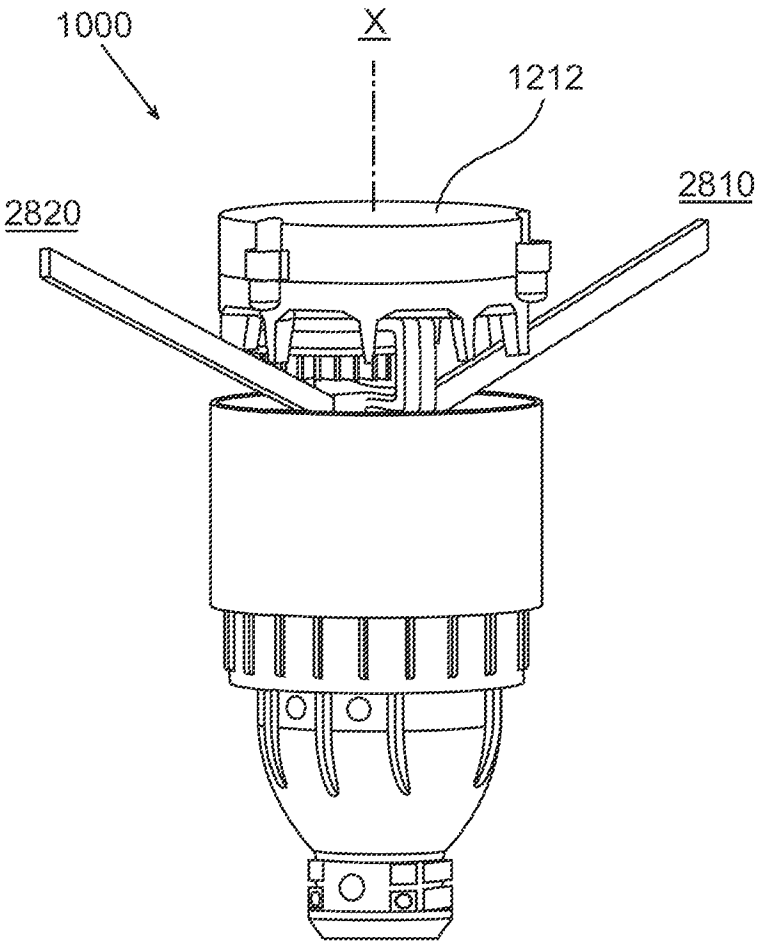

Attention is drawn to FIG. 9A providing a perspective side view and FIG. 9B providing a partial cross-sectional view, of sprinkler 1000. The second liquid stream 2820 of sprinkler 1000 powers via "rotor" impact member 1400 the "power train" of cogwheels 7, 9, 13 and 15 best seen in FIG. 6A—while the first liquid stream 2810 is accordingly emitted along a "free" path out of the sprinkle except during instances where it impacts an impinging member 3010 to urge rotation of the cover.

As seen in the cross-sectional view of FIG. 9B, during operation the sprinkler rises and remains at an elevated operative position. At this elevated/raised position the sprinkler, here via its nozzle 1800, 'presses' against portions of the sprinkler. In this example, such 'pressing' action occurs against a seal 1900.

In any case, friction occurring due to this 'pressing' action creates frictional forces that are designed to form a 'primary anchoring region' suited to substantially resist rotational forces occurring during operation of the sprinkler. In this example, friction occurring, inter alia, where nozzle 1800 presses against seal 1900 contributes to formation of the 'primary anchoring region' 1905.

At an upper side of the nozzle 1800 on the other hand, smaller frictional forces occurring at a region where stream deflector 1600 couples to the nozzle, form a 'secondary anchoring region' 1910 that is less resistant to rotational forces than the 'primary anchoring region' 1905.

When viewing sprinkler 1000 from above, in an arrangement where cogwheels 7 and 9 and impact member 1400 are arranged to rotate in a first rotational direction (e.g. counter-clockwise motion)—cogwheels 11, 13 and 15 will be urged to rotate in a second opposing rotational direction (e.g. clockwise motion)—resulting in this embodiment in rotational movement of the sprinkler's cover 1212 while the liquid streams 2810, 2820 remain fixed in place due to friction occurring at the 'primary anchoring region' 1905 and the 'secondary anchoring region' 1910. Again, in this embodiment, fifth gear 15 is fixed to the cover and thus may be considered an internal gear. In the example seen in FIGS. 7-9, however, the cover 1212 rotates relative to the housing 1111, and so fifth cogwheel 15 is consequently also rotates relative to the housing 1111.

Cover 1212 rotates about the sprinkler's axis X until one of its impinging members 3010 intercepts liquid stream 2810 to consequently form a moment force M that overcomes the frictional forces existing at the 'secondary anchoring region' 1910. In turn an incremental rotational movement of deflector 1600 is formed about the sprinkler's axis X, which advances deflector 1600 about sprinkler axis X so that a new sector about sprinkler axis X receives irrigation.

This action of interaction between the cover's impinging member and liquid stream 2810 repeats itself each time an impinging member intercepts the liquid streams 2810 resulting in incremental rotational movements of the liquid streams about sprinkler axis X to provide even irrigation about the axis.

It is noted that impinging members 3010 according to various embodiments of the invention may take various forms, other than those illustrated. For example, the angle of slanting of an impinging member 3010 at its impact face 3011 relative to an incoming liquid stream 2810 may vary—affecting the moment force M applied upon the cover. In some cases, such variance may exist in the same sprinkler. Also, angular distances between impinging members may vary—resulting at least in some (and possibly all) impinging members not necessarily being symmetrically distributed about the sprinkler's axis. Such variances may assist in obtaining a more arbitrary distribution of liquid about the sprinkler's axis resulting in a more even distribution of irrigation by such sprinkler embodiments.

While the invention has been illustrated and described in detail in the drawings and foregoing description, such illustration and description are to be considered illustrative or exemplary and non-restrictive; the invention is thus not limited to the disclosed embodiments. Variations to the disclosed embodiments can be understood and effected by those skilled in the art and practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be considered as limiting the scope.

Although the present embodiments have been described to a certain degree of particularity, it should be understood that various alterations and modifications could be made without departing from the scope of the invention as hereinafter claimed.

What is claimed is:

1. A rotating sprinkler (10) having a vertical sprinkler axis (X), and comprising:

a housing (1) extending along the sprinkler axis (X); and a movable core (2) having retracted and extended states relative to the housing (1), the movable core (2) comprising:

a core body (160) provided with a stream deflector (16) and a hinge (17), the hinge (17) having a hinge axis (H) which is orthogonal to the sprinkler axis (X);

a cover (12), and an impact member (14) having a liquid path (28) therethrough; wherein:

in the extended state, both the cover (12) and the impact member (14) are configured to pivot independently from one another about the hinge (17) between pivoted and non-pivoted states, while the stream deflector (16) is fixed against rotation about the hinge (17).

2. The rotating sprinkler of claim 1, wherein:

the core body (160) further comprises an integrally formed primary stop (161); and in the extended state, the cover (12) is configured to pivot about the hinge (17) to the pivoted state in which at least a portion of the cover (12) abuts against the primary stop (161).

3. The rotating sprinkler of claim 2, wherein:

the impact member (140) comprises an integrally formed secondary stop (141); and in the extended state, the impact member (140) is configured to pivot about the hinge (17) to where the secondary stop (141) abuts against a portion of the cover (12).

4. The rotating sprinkler of claim 1, wherein:

in the extended state, in the pivoted state, the impact member (14) is positioned opposite the stream deflector (16) and is configured to receive, into the liquid path (28), a liquid jet emitted by the stream deflector (16).

5. The rotating sprinkler of claim 4, wherein the impact member (14) is configured to pivot about the hinge (17), in response to having liquid pass through the liquid path (28) of the impact member (14).

6. The rotating sprinkler of claim 4, wherein the movable core (2) is configured to rotate about the sprinkler axis (X), in response to having liquid pass through the liquid path (28) or the impact member (14).

7. The rotating sprinkler of claim 1, wherein:

the sprinkler has an inlet (26) connected to an upstream liquid source; and the sprinkler is configured to transition from the retracted state towards the extended state, in response to exposure to pressurized liquid entering the inlet (26) from said upstream liquid source.

8. The rotating sprinkler of claim 1, wherein the impact member (14) comprises an S-shaped liquid path (28).

9. The rotating sprinkler of claim 1, wherein the impact member (14) has an entry (1401) at one end and an exit (1402) at an opposite end, and the liquid path (28) extends between the entry (1401) and the exit (1402).

10. A rotating sprinkler (10) having a vertical sprinkler axis (X), and comprising:

a housing (1) extending along the sprinkler axis (X); and a movable core (2) having retracted and extended states relative to the housing (1), the movable core (2) comprising:

a core body (160) provided with a stream deflector (16) and a hinge (17), the hinge (17) having a hinge axis (H) which is orthogonal to the sprinkler axis (X);

a cover (12), and an impact member (14) having entry (1401) at one end and an exit (1402) at an opposite end, and a liquid path (28) extending between the entry 1401) and the exit (1402);

wherein:

in the extended state, both the cover (12) and the impact member (14) are configured to pivot about the hinge (17) between pivoted and non-pivoted states, while the stream deflector (16) is fixed against rotation about the hinge (17).

11. The rotating sprinkler of claim 10, wherein:

the core body (160) further comprises an integrally formed primary stop (161); and in the extended state, the cover (12) is configured to pivot about the hinge (17) to the pivoted state in which at least a portion of the cover (12) abuts against the primary stop (161).

12. The rotating sprinkler of claim 11, wherein:

the impact member (140) comprises an integrally formed secondary stop (141); and in the extended state, the impact member (140) is configured to pivot about the hinge (17) to where the secondary stop (141) abuts against a portion of the cover (12).

13. The rotating sprinkler of claim 10, wherein:

in the extended state, in the pivoted state, the impact member (14) is positioned opposite the stream deflector (16) and is configured to receive, into the liquid path (28), a liquid jet emitted by the stream deflector (16).

14. The rotating sprinkler of claim 13, wherein the impact member (14) is configured to pivot about the hinge (17), in response to having liquid pass through the liquid path (28) of the impact member (14).

15. The rotating sprinkler of claim 13, wherein the movable core (2) is configured to rotate about the sprinkler axis (X), in response to having liquid pass through the liquid path (28) or the impact member (14).

16. The rotating sprinkler of claim 10, wherein:

the sprinkler has an inlet (26) connected to an upstream liquid source; and the sprinkler is configured to transition from the retracted state towards the extended state, in response to exposure to pressurized liquid entering the inlet (26) from said upstream liquid source.

17. The rotating sprinkler of claim 10, wherein the impact member (14) comprises an S-shaped liquid path (28).

* * * * *